United States Patent [19]

Hyman et al.

[11] 4,207,696

[45] Jun. 17, 1980

[54] SOUND ACTIVATED MOBILE

[76] Inventors: Gregory E. Hyman, 22 Cross Hill Ave., Yonkers, N.Y. 10703; Lawrence J. Greenberg, 64 Mountain Ave., Larchmont, N.Y. 10538

[21] Appl. No.: 929,530

[22] Filed: Jul. 31, 1978

[51] Int. Cl.[2] ..... G09F 11/00

[52] U.S. Cl. ..... 40/473; 40/457

[58] Field of Search ..... 46/248, 32; 40/473, 40/411, 616, 455, 456, 457; 200/61.01; 318/484

[56] References Cited

U.S. PATENT DOCUMENTS

| | | | |
|---|---|---|---|
| 1,913,150 | 6/1933 | Atwater | 40/473 |
| 2,828,963 | 4/1958 | Steiner | 272/31 R |
| 2,957,957 | 10/1960 | Johnson | 200/61.01 |
| 2,990,646 | 7/1961 | Berger | 200/61.01 |
| 3,444,646 | 5/1969 | Domashovetz | 200/61.01 |
| 3,716,756 | 2/1973 | Runge et al. | 318/484 |
| 3,927,482 | 12/1975 | Marcus | 40/455 |
| 4,055,014 | 10/1977 | Schmidt et al. | 40/457 |

*Primary Examiner*—John W. Shepperd
*Attorney, Agent, or Firm*—Henry Sternberg

[57] ABSTRACT

An apparatus for rotating a mobile. The apparatus has a drive means and a sound activated switch, operatively connected to the drive means for activating the latter in response to sound.

5 Claims, 3 Drawing Figures

SOUND ACTIVATED MOBILE

BACKGROUND OF THE INVENTION

The present invention relates to a sound activated mobile.

Previously, mobiles, and particular mobiles used a crib toys, were manually actuated and therefore required the presence of another person to start them, etc. For example, in the case of the spinning crib toy disclosed in U.S. Pat. No. 3,060,628, wherein a pull on a cord rotates a drum while energy is stored in a helical spring which then causes rotation of the drum in the opposite direction.

Other toys of this type were motorized but required the presence and help of another person to actuate a mechanical switch. The motorized mobile would continue to rotate until the switch was manually turned off. Such a device is taught by U.S. Pat. No. 3,919,795.

Still another type of mobile was known in which the motion of the mobile was controlled by changes in ambient temperature. For example, U.S. Pat. No. 3,811,990 discloses a thermally activated mobile.

None of the known devices were in any way controllable by the baby for whose pleasure they were designed. Indeed, each of these devices required the attention of another person or were controlled by conditions, such as temperature, that were not under the direct control of any person. The known devices could not, therefore, provide the additional educational experience made possible by the apparatus according to the present invention.

DESCRIPTION OF THE PREFERRED EMBODIMENTS

In a preferred embodiment of apparatus according to the present invention there is a drive means comprising an energy conversion means, such as a motor. The drive means is connected to an energy storage means such as, for example, a cord, string, spring or wire. The motor is activated for only a short period of time in order for it to transfer energy to the energy storage means where the energy is stored. The cord or spring then releases its energy, causing rotation of the mobile to which it is connected.

Use of an energy storage means is preferred, inter alia, because it permits storage of sufficient energy required to overcome the initial resistance (inertia) of the mobile to start turning from a rest position, without requiring a more expensive, higher powered, motor. The energy storage means also permits intermittent operation of the energy conversion means resulting in longer battery life if, as in the preferred embodiment, batteries are used for providing power to the energy conversion means. Thus, while the drive means of the apparatus according to the present invention may be a motor that continuously rotates a mobile without any provision for storage of energy, the preferred embodiment includes an energy storage means.

Preferably, the apparatus according to the present invention also includes a time delay means for preventing a second activation of the drive means for a desired period of time. Such time delay means serves two functions. It makes the rotation response of the mobile less predictable and, when used in the preferred embodiment of the invention comprising an energy storage means, it results in intermittent operation of the energy conversion means, thus preventing excessive rotational speed of the mobile. Such excessive speed, caused by a continuously operating motor coupled directly to the energy storage means so as to continuously supply the latter with rotational energy, could result in damage to the apparatus.

The invention will now be further described by reference to the drawings in which:

FIG. 3 is a schematic diagram of typical electronic circuitry used in the apparatus according to the present invention.

Figures 1, 2:
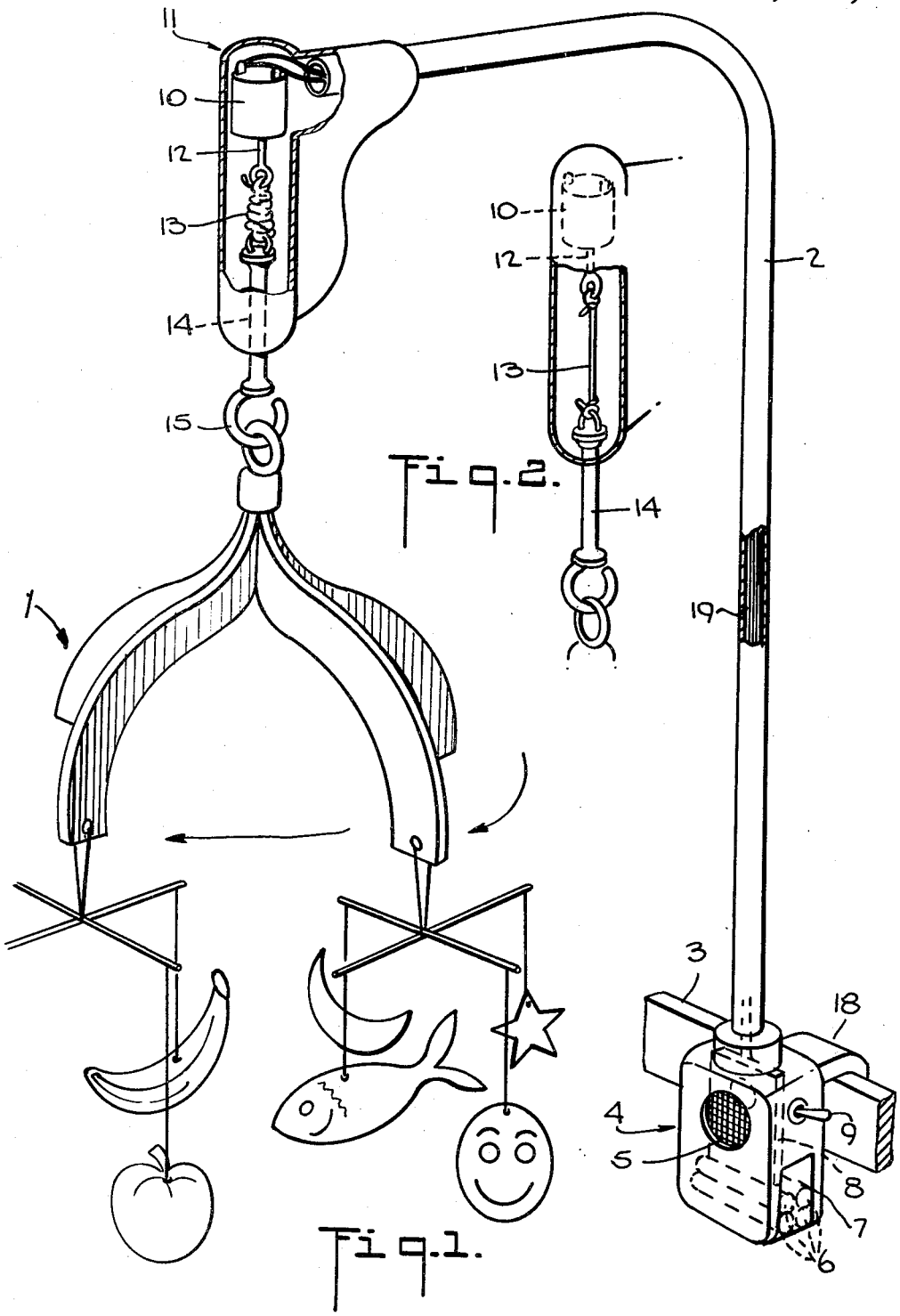
FIG. 1 is a perspective view of a preferred embodiment of the present invention, showing it mounted on a crib rail. The cord and the connector between the mobile and the cord are shown in the position assumed by them just after the motor has stopped turning.
FIG. 2 is an enlarged, partly cut-away, side view of the drive means according to the preferred embodiment of the present invention showing the cord and the connector after the cord has reached its fully unwound condition.
Figure 8:
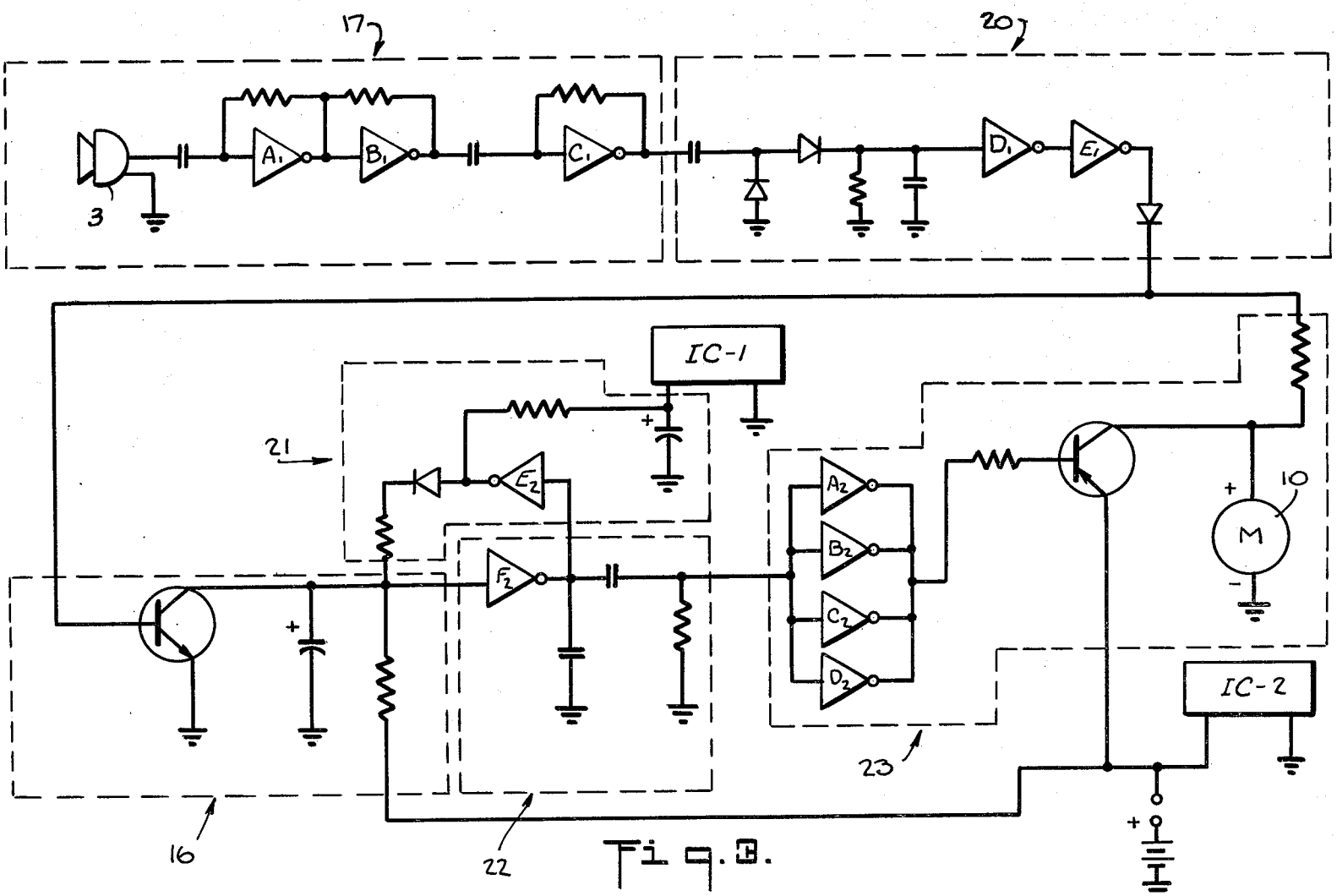

Referring to the preferred embodiment of the present invention shown in FIGS. 1–3, it will be seen that the invention resembles a conventional crib mobile consisting of a free hanging mobile element (1) suspended by a support (2) which is attachable to rail (3) of a crib by way of a bracket (18). Unlike conventional devices of this sort, however, motion of the mobile (1) is initiated by sound and is therefore controllable by the baby. Motion of the mobile (1) is not dependent on other persons or on extraneous forces such as ambient temperature variation.

Contained within the housing (4) which is attachable by bracket (18) on the crib rail (3) is a microphone (5) batteries (6) (preferably four size "AA" batteries) accessible via a battery access door (7) and electronic circuitry (8). A detailed schematic diagram of typical electronic circuitry appears in FIG. 3.

The apparatus according to the present invention is able to sense sound in its vicinity (e.g., in the area of a crib). Upon detecting a sound, the microphone (5) (an example of a preferred microphone is the Aristo Craft M1 available from Aristo Craft, 314 Fifth Avenue, New York, N.Y. York 10001), sends an impulse to an electric motor (10) (preferably a 6 volt motor having 0.6 inch per ounce torque at stall and drawing a current of 0.15 amperes at stall, for example Motor Model No. RE260-08450, available from Mabuchi Motor America Corp., 475 Park Avenue, New York, N.Y. 10016), located in a housing (11) which is connected to the housing (4) by a support (2) comprising a tubular member bent at a right angle. The electronic circuitry (8) is connected to the motor (10) by wires (19) running within the support (2). When the motor is energized, the rotating motor shaft (12) causes the cord (13) (for example a stranded hemp cord having a length of approximately 4 inches and a diameter of approximately 0.012 to 0.015 INches or a spring (not illustrated)), to be wound. The cord (13) is contained within the housing (11) so that it is not accessible, both for safety reasons and so that the cord winding operation will not be interfered with. If a cord (13) is used, the connector (14) will be drawn up into the housing (11) to some extent (as seen in FIG. 1) during the winding operation. After the cord (13) is wound to the extent that the motor (10) stalls (in the preferred embodiment illustrated herein this occurs approximately 3 seconds after energizing of the motor (10)), the electronic circuitry (8) cuts off substantially all further current to the motor (1) and at the same time also to the microphone (3). The stored energy in the wound up cord (13) and the raised connector (14) then causes the mobile (1), which is preferably attached to the cord by a hook and eye (15) at the end of the connector (14), to rotate until the cord (13) is completely unwound (preferably about 90 seconds) as illustrated in FIG. 2. A time delay means (16) in the electronic circuitry (8) cuts off power to the microphone (5) and its associated circuitry ((17) and (20)) for a period of time sufficient to permit the cord (13) to unwind. During this period of time, the apparatus is not in a "listening" condition. By essentially deenergizing the apparatus for about 90 seconds, the time delay means conserves battery power and also prevents the motor from being turned on for the desired period of time that the apparatus is not "listening". Further noise or crying by the child during the time delay period (i.e., during rotation of the mobile and, if desired, for a predetermined time thereafter) does not reactivate the mobile and therefore lends a feature of unpredictability to the apparatus which can result in a learning experience for the child. That is, the child may recognize that rotation of the mobile is not always a predictable result of his or her screaming or crying. After about 90 seconds, or other desired time period after the cord (13) is fully unwound, the time delay means (16) once again energizes the circuit to the microphone (5) and the apparatus is once more in "listening" condition, ready to cause the motor (10) to again wind up the cord (13) the next time the baby makes a sound. The apparatus according to the present invention is normally in a "listening" condition while the power switch (9) is in the "on" position, the batteries (6) are in place and the electronic circuitry (8) is not in a time delay condition.

A typical electronic circuit comprising amplifier (17), voice switch (20), amplifier disable switch (21), long duration timer (16), short duration timer (22) and motor control (23) sections, is schematically illustrated in FIG. 3. In FIG. 3, invertors A, B, C, D and E, are included in the integrated circuit IC-1 which gets its power at the terminals represented in the schematic illustration, and invertors $A_2$, $B_2$, $C_2$, $D_2$, $E_2$ and $F_2$ are included in the integrated circuit IC-2 which gets its power at the terminals represented in the schematic illustration.* While the electronic circuit of FIG. 3 is referred to herein, further description is not necessary since circuits such as the one illustrated are well known to those in the art.

*Integrated circuits IC, and $IC_2$ are identical units type CD-4069B available from several manufacturers such as National Semiconductor Corp., 2900 Semiconductor Drive, Santa Clara, Calif.

It will be understood that each of the elements described above, or two or more together, may also find a useful application in other types of constructions differing from the types described above.

It will also be understood that the various preferred elements of the apparatus according to the present invention may be combined in various ways to give various preferred embodiments of the present invention.

While the present invention has been illustrated and described above, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of the present invention and, therefore, such adaptations should and are intended to be comprehended within the meaning and range of equivalence of the following claims.

We claim:

1. A sound activated apparatus comprising: a rotatable mobile, electric drive means, power transmitting means including energy storage means operatively connecting said mobile to said electric drive means for rotating said mobile in response to release of energy previously stored in said energy storage means by said electric drive means and sound activated switch means operatively connected to said electric drive means for activating said electric drive means in response to sound detected by said sound activated switch means, and time delay means co-operating with said electric drive means for preventing a further activation of said electric drive means within a predetermined period of time after a prior activation of said electric drive means so that the mobile will provide a pacifying distraction to a baby in response to such baby crying but will not be energized needlessly in response to the baby crying continuously or a second time during said predetermined period.

2. The apparatus of claim, 1 wherein said operative connection between said electric drive means snd said sound activated switch means comprises electric circuit means and said electric circuit means includes battery connection means for attachment to a battery.

3. The apparatus of claim 1 wherein said energy storage means is a cord.

4. The apparatus of claim 3 further comprising housing means for containing said cord.

5. The apparatus of claim 1, wherein said time delay means prevents a second activation of said electric drive means for for at least as long as the length of time required for said energy storage means to be depleted of its stored energy.

* * * * *